US006589074B1

(12) United States Patent
Wu

(10) Patent No.: US 6,589,074 B1
(45) Date of Patent: Jul. 8, 2003

(54) TWO PORTS INTEGRAL ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/210,383

(22) Filed: Jul. 31, 2002

(51) Int. Cl.[7] ..... H01R 13/60
(52) U.S. Cl. ..... 439/540.1; 439/567; 439/677
(58) Field of Search ..... 439/540.1, 567, 439/677, 674, 660

(56) References Cited

U.S. PATENT DOCUMENTS 3,376,543 A * 4/1968 Hammell ..... 439/540.1
3,915,541 A * 10/1975 Flegel ..... 439/540.1
4,115,665 A * 9/1978 Giacoppo et al. ..... 439/540.1
5,076,804 A * 12/1991 Bertho et al. ..... 439/567
5,626,482 A 5/1997 Chan et al.
5,842,874 A 12/1998 Yagi et al.
6,050,845 A * 4/2000 Smalley et al. ..... 439/417

* cited by examiner

*Primary Examiner*—Tho D. Ta
(74) *Attorney, Agent, or Firm*—Wei Te Chung

(57) ABSTRACT

An electrical connector (1) for being mounted on a printed circuit board (5) includes an insulative housing (2) defining a number of passageways (220), and a number of contacts (3) received in the passageways. The housing includes a first and a second base sections (20,21) arranged parallel to each other, a first and second mating sections (22,23) projecting from the first and second base sections, and an interconnect portion (27) interconnected the first base section with the second base section. The interconnect portion further comprise a retention portion (28) defining a receiving cavity (280). A board lock (4) is received in the receiving cavity and has a pair of engaging tails (43) engaging with inner walls of holes defined in the printed circuit board for securing the connector onto the printed circuit board.

2 Claims, 9 Drawing Sheets

TWO PORTS INTEGRAL ELECTRICAL CONNECTOR

CROSS-REFERENCE TO RELATED APPLICATIONS

This application is a co-pending application of Patent Application Serial No. 09/930,842, entitled "ELECTRICAL CONNECTOR", U.S. Pat. No. 6,447,340, assigned to the same assignee. The disclosure of the co-pending application is wholly incorporated herein by reference.

BACKGROUND OF THE INVENTION

1. Field of the Invention

The present invention relates to an electrical connector, and particularly to a Serial ATA (Advanced Technology Attachment) connector used in hard disk drives for signal transmission.

2. Description of Related Art

With the development of computer technology, a new product, named as a serial ATA (Advance Technology Attachment) electrical connector, is proposed for use as an interface of fast-talking drives, which will effectively improve the bandwidth, or capacity for data, between hard disk drives and other PC components, with respect to the parallel ATA connector. The serial ATA connector also has some other improvements comparing with the parallel ATA, such as low cost, low pin count, and low voltage requirement, and so on. In a word, the serial ATA connector provides a long-term solution for high performance, and easier, more flexible system design.

Commonly, a serial ATA connector mounted on a printed circuit board includes an insulative housing and a plurality of signal, power and ground contacts retained in the housing. Furthermore, with the miniaturization and dense trend of notebook computers, it is desired that the width of housing which is mounted on the printed circuit board could be as narrow as possible for reducing its layout space on the printed circuit board. However, if the housing becomes too narrow, which will be adversely affected the stability of the connector on the printed circuit board during the soldering process.

Hence, an improved electrical connector is required to overcome the disadvantages of the related art.

SUMMARY OF THE INVENTION

Accordingly, an object of the present invention is to provide an electrical connector, that may be securely mounted onto printed a circuit board.

Accordingly, another object of the present invention is to provide an electrical connector having two ports for mating with two mating connector at the same time.

In order to achieve the objects set forth, an electrical connector of the present invention for being mounted on a printed circuit board comprises an insulative housing defining a number of passageways, and a number of contacts received in the passageways. The housing includes a first and a second base section arranged parallel to each other, a first and second mating section respectively projecting from the first and second base section, and an interconnect portion interconnected the first base section with the second base section. The interconnect portion comprises a retention portion that defines a receiving cavity. A board lock is received in the receiving cavity and comprises a base portion, a pair of barbs formed on opposite sides of the base portion and a pair of legs extending downwardly from a bottom end thereof for engaging with an inner wall of a hole defined in the printed circuit board, thereby pre-retaining the electrical connector onto the printed circuit board before soldering.

Other objects, advantages and novel features of the invention will become more apparent from the following detailed description when taken in conjunction with the accompanying drawings.

DETAILED DESCRIPTION OF THE INVENTION

Figure 1:
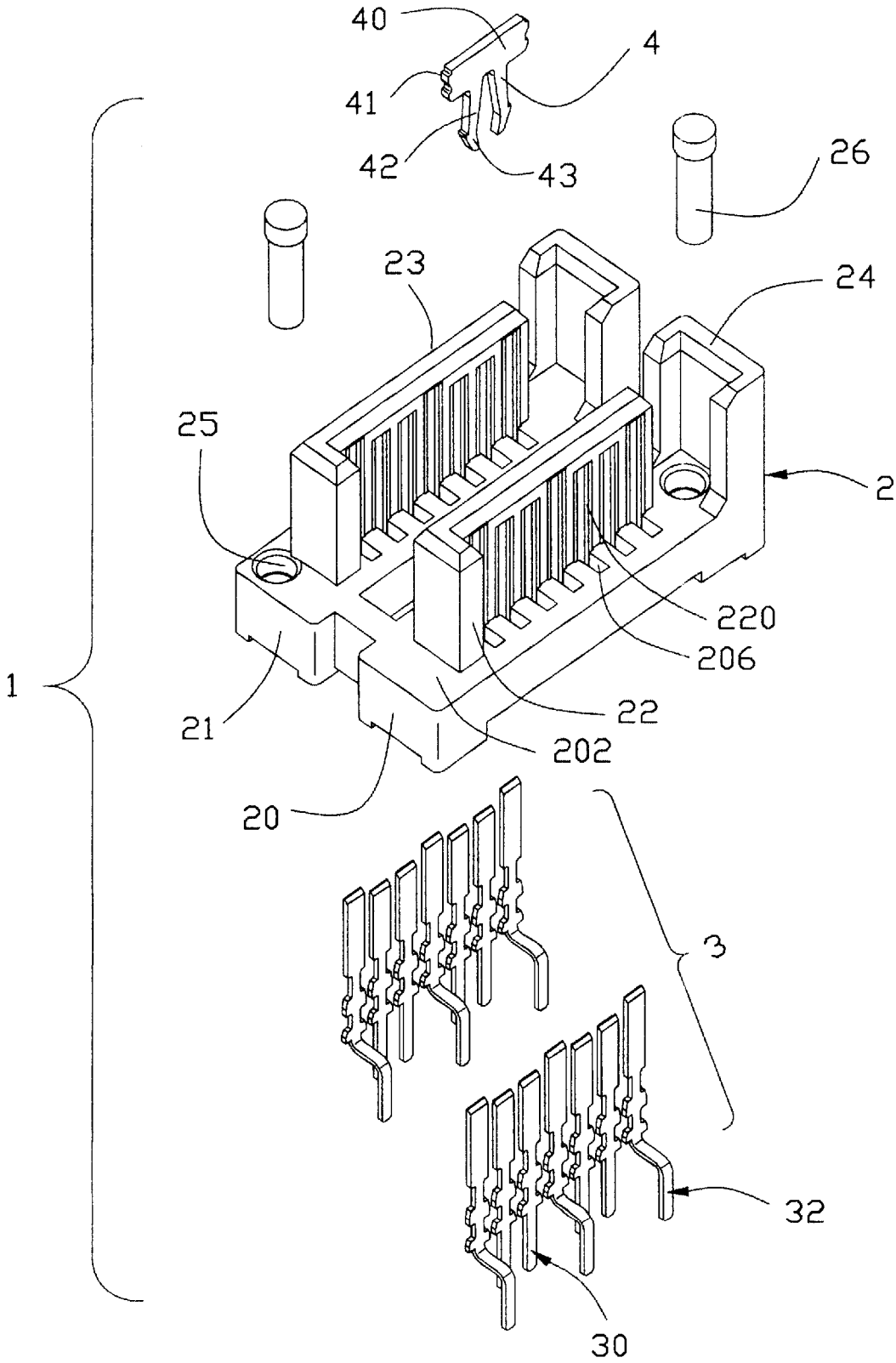
FIG. 1 is an exploded perspective view of a Serial ATA connector in accordance with the present invention.
Figure 2:
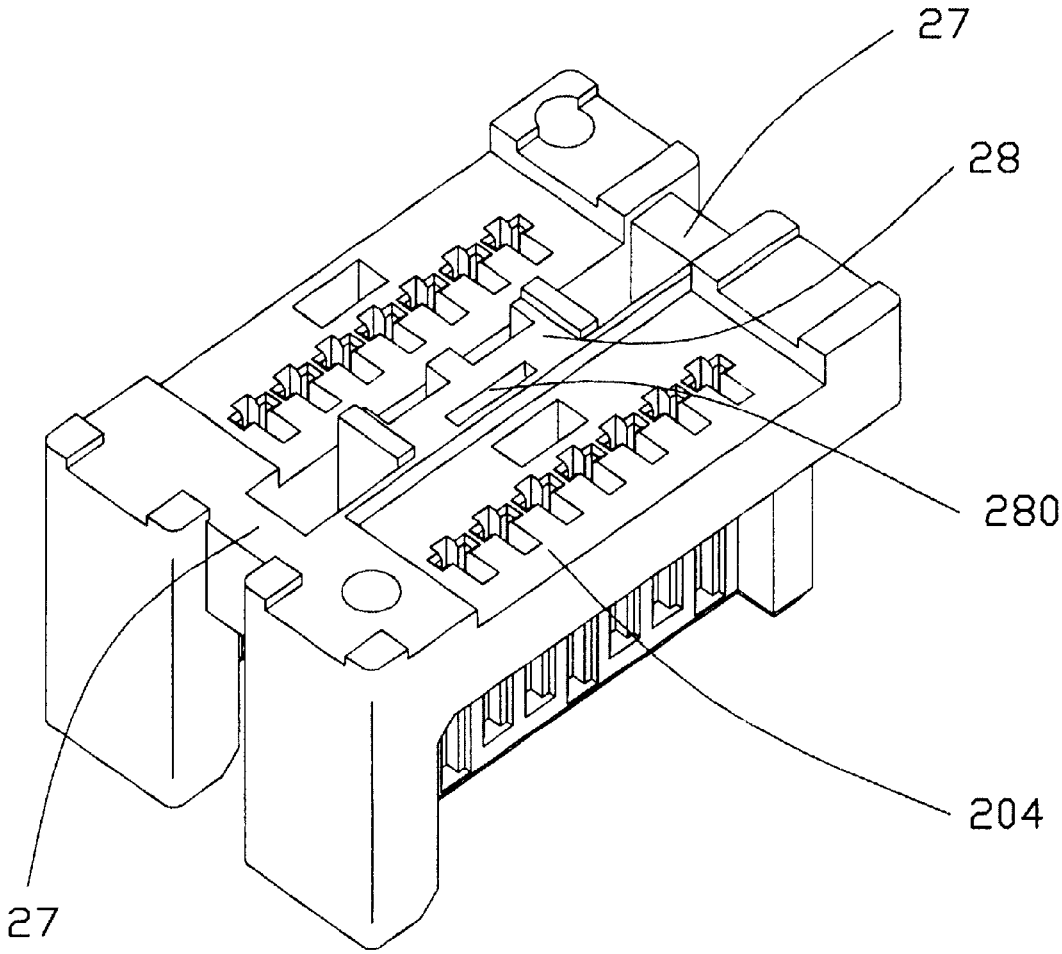
FIG. 2 is a bottom, perspective view of a housing of the connector of FIG. 1.
Figure 3:
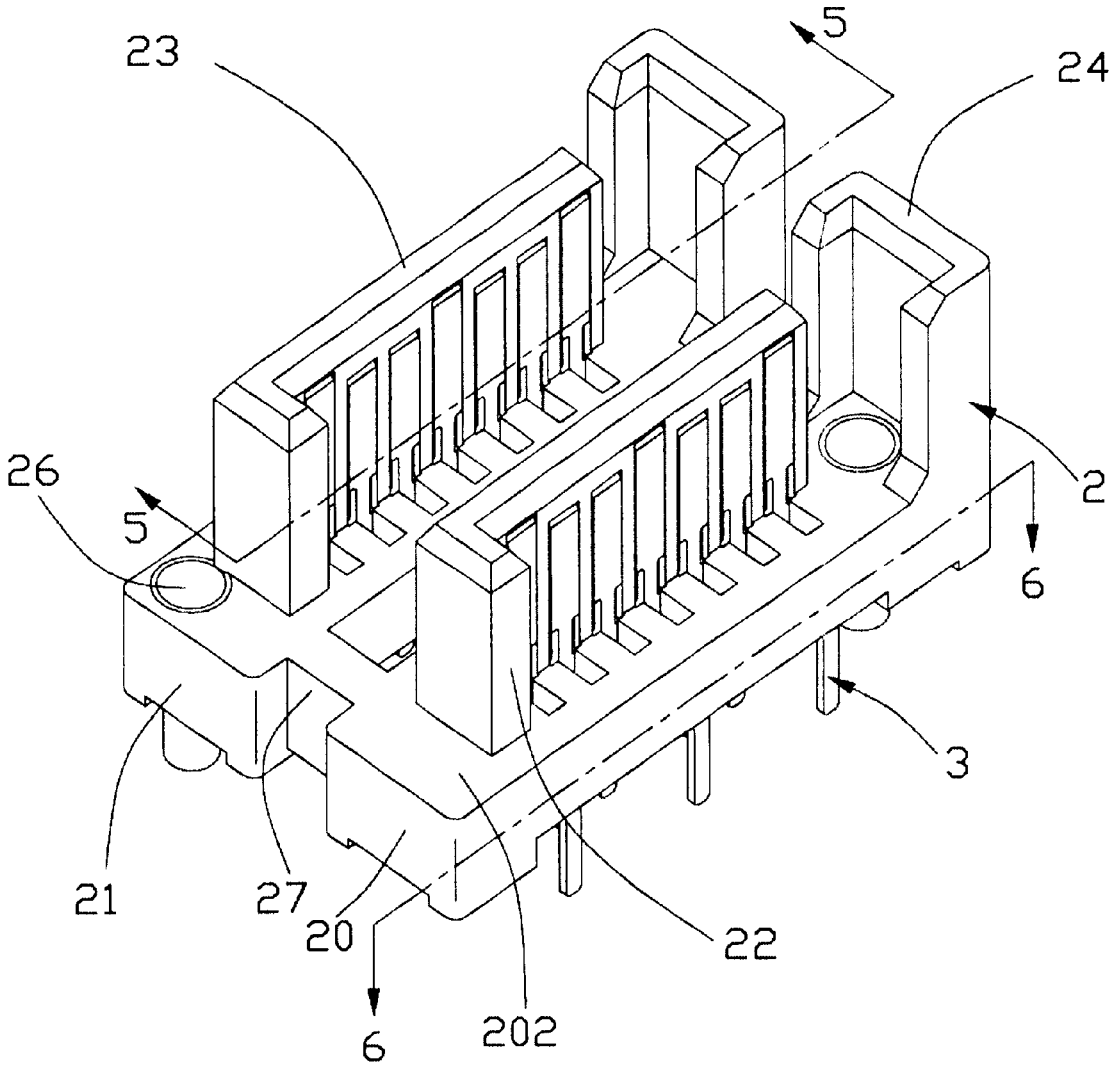
FIG. 3 is a top perspective view of the connector of FIG. 1.
Figure 4:
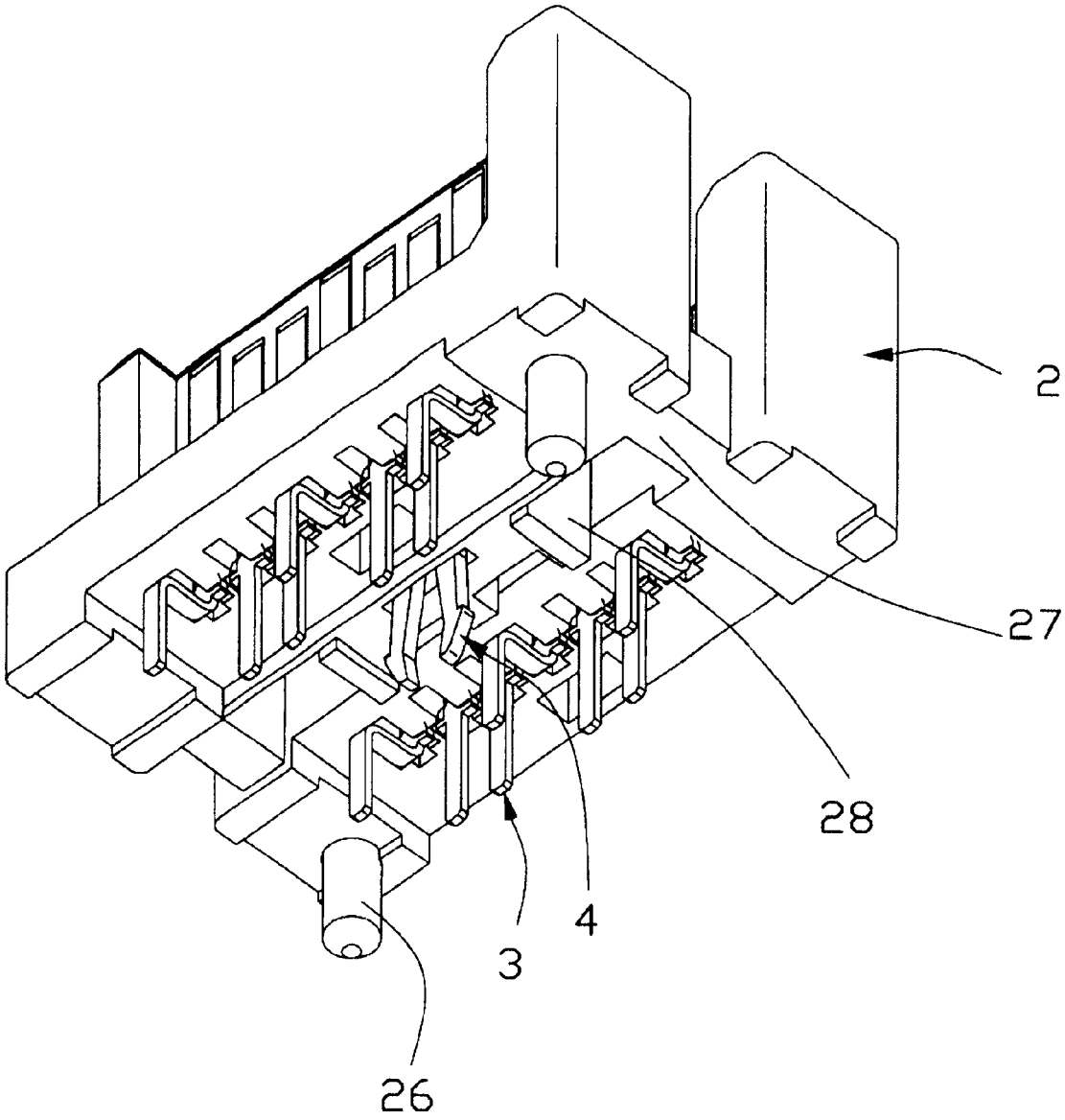
FIG. 4 is a bottom, perspective view of the connector of FIG. 3.
Figure 5:
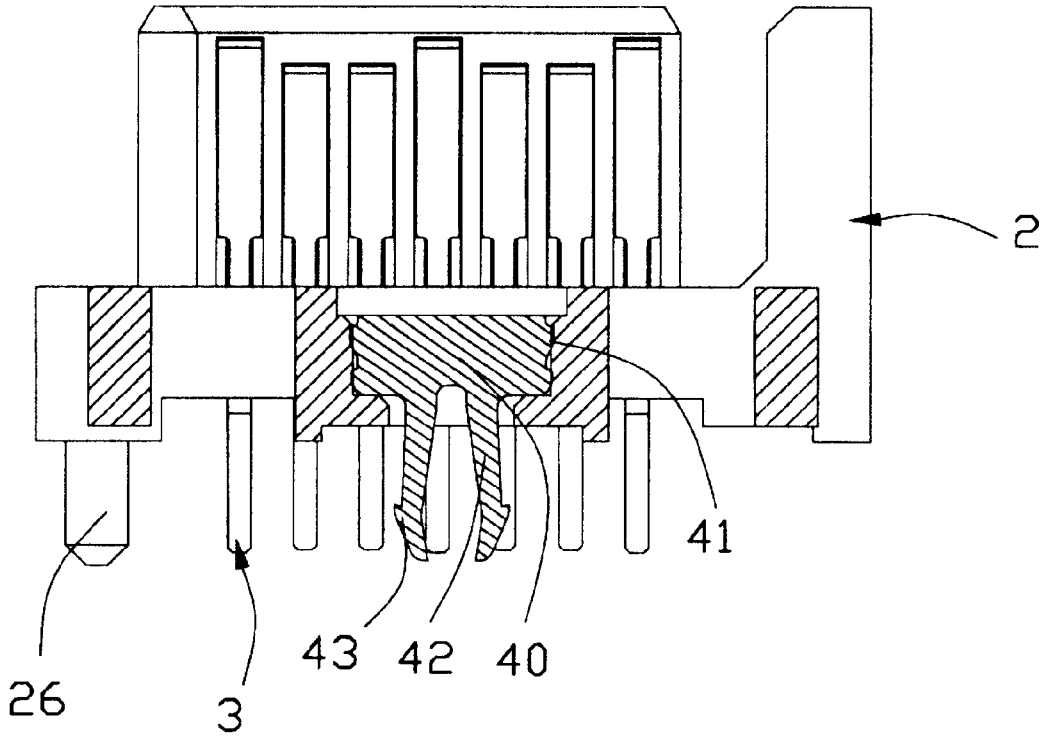
FIG. 5 is a cross-sectional view of the connector taken along line 5—5 of FIG. 3.
Figure 6:
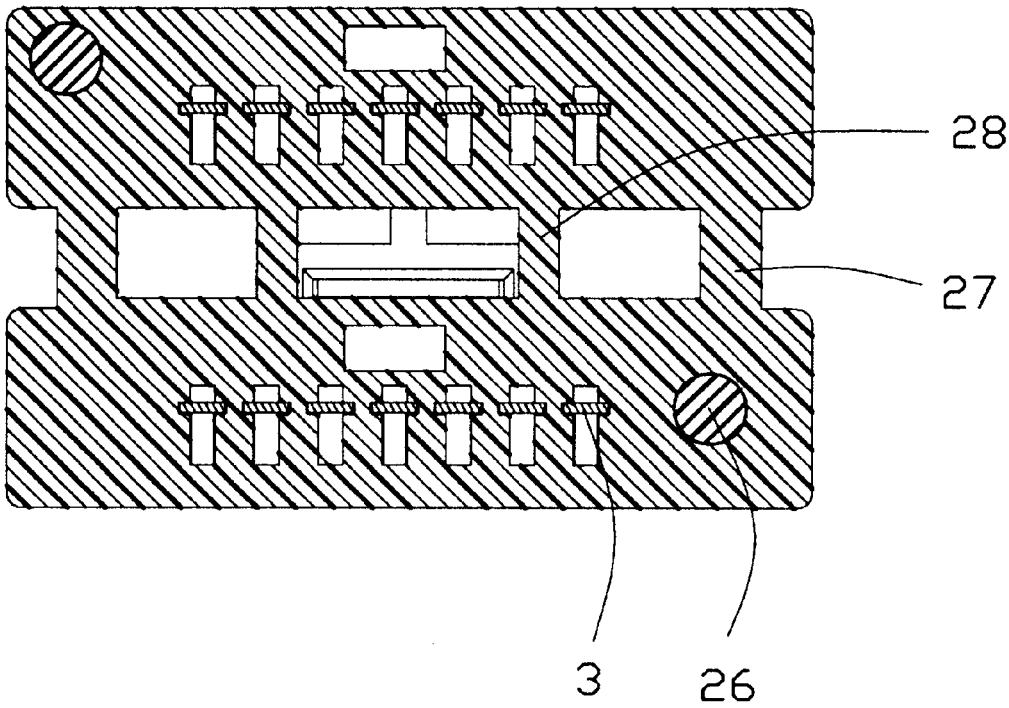
FIG. 6 is a cross-sectional view of the connector taken along line 6—6 of FIG. 3.
Figure 7:
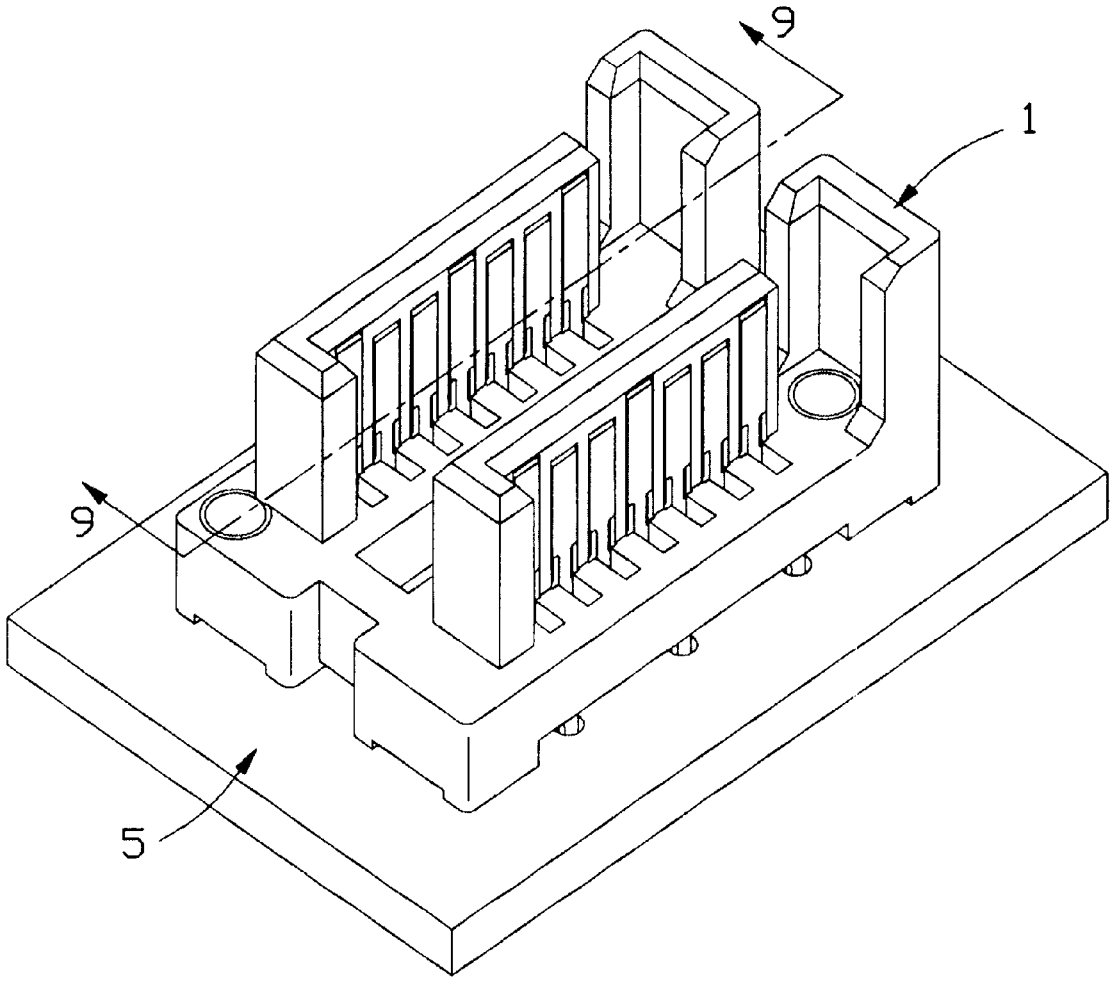
FIG. 7 is a top perspective view of the connector and a printed circuit board on which the connector mounts.
Figure 8:
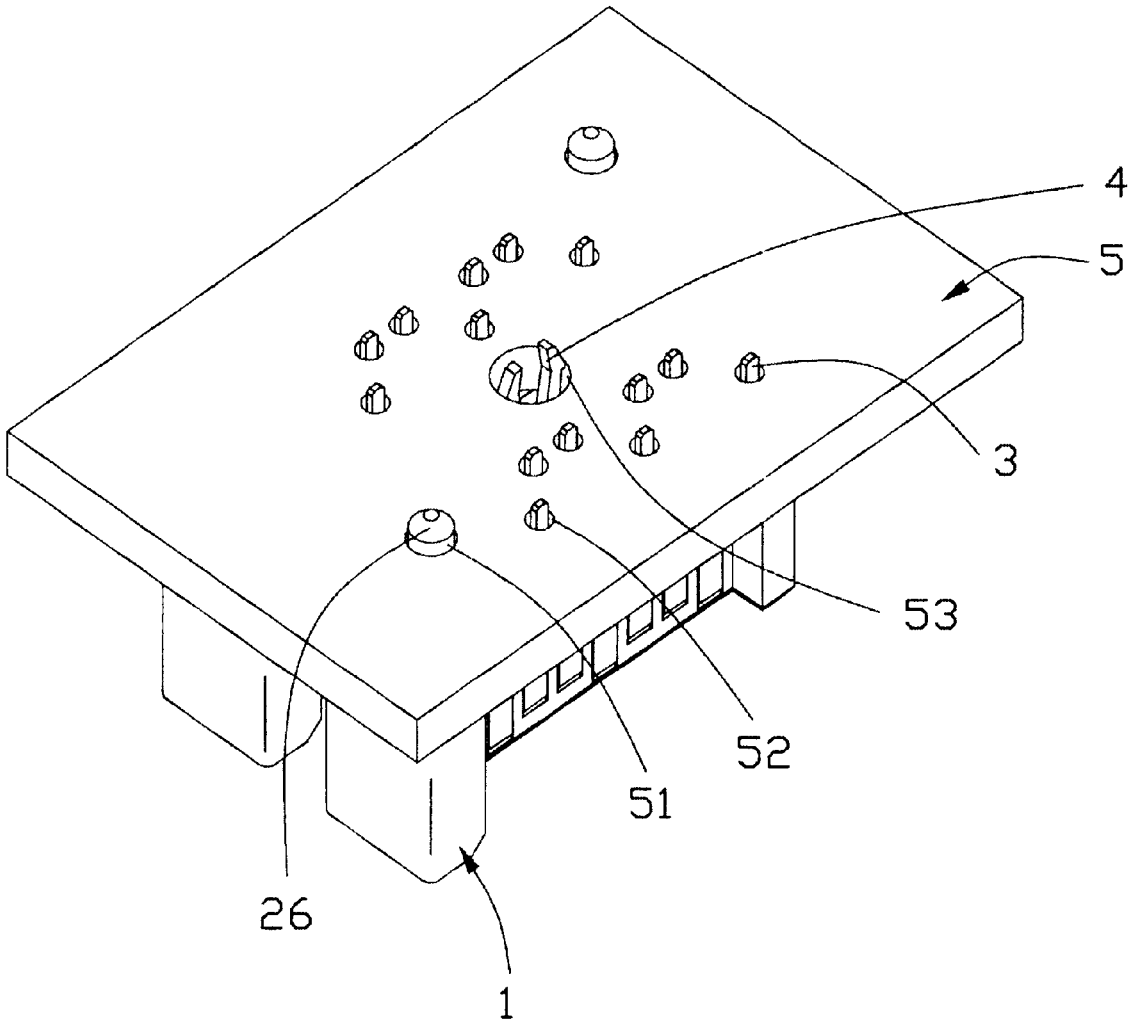
FIG. 8 is a bottom perspective view of FIG. 7.
Figure 9:
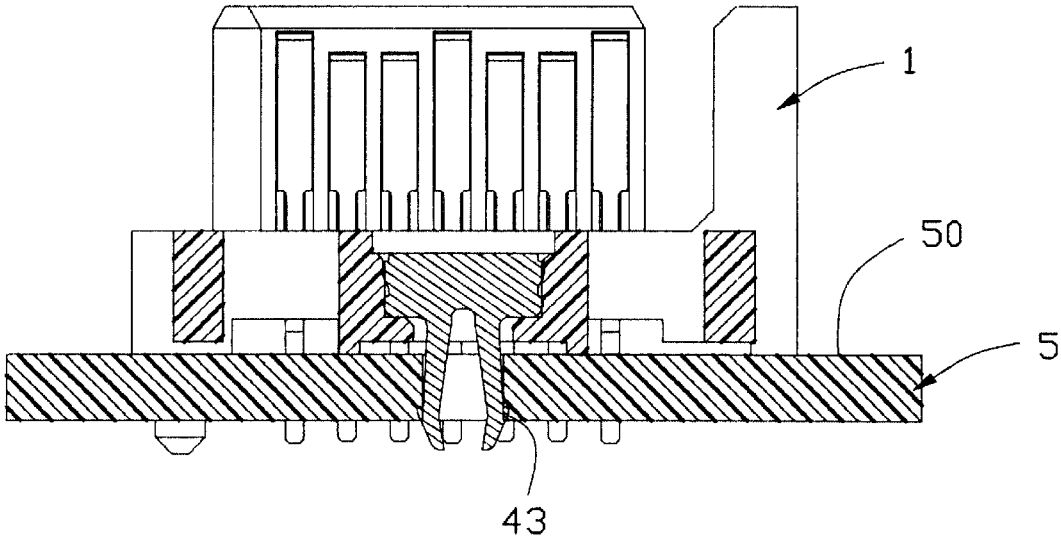
FIG. 9 is a cross-sectional view of the connector and the printed circuit board taken along line 9—9 of FIG. 7.

Referring to FIGS. 1, 2 and 3, a Serial ATA connector 1 in accordance with the present invention comprises an insulative housing 2, a plurality of contacts 3 received in the housing 2, a board lock 4 and a pair of individual posts 26 fixed to the housing 2 for retaining the housing 2 with the contacts 3 to a mother board 5 (FIGS. 7–9).

The insulative housing 2 is made of plastic. The housing 2 comprises a first and second base section 20, 21 spaced apart from each other in a substantially parallel relationship, a first and second mating section 22, 23 projecting from top surface 202 of the first and second base section 20, 21. Each base portion 20, 21 comprises a side arms 24 upwardly extending from one end thereof. Each mating section 22, 23 defines a plurality of passageways 220 extending to a bottom surface 204 of the base section 20. The passageways 220 are arranged in a single row. The side arm 24 defines a receiving channel therein for receiving a corresponding alignment post of a complementary connector (not shown) to ensure a blind mating connection. The first and second base section 20, 21 are interconnected by a pair of interconnect portions 27. The interconnect portions may be integrally formed with base portions 20, 21 or they may be separately formed from the base portions 20, 21. Each base section 20, 21 has a circular through hole 25, whereby the through holes 25 are defined in a diagonal line of the housing 2.

Each mating section 22, 23 defines a plurality of inwardly extending corresponding passageways 220 and through the bottom surface 204 of the base section 20. Each base section 20, 21 defines a plurality of channels 206 between the top surface 202 and the bottom surface 204 thereof. Each channel 206 communicates with a corresponding passageway 220.

The contacts 3 are received in the passageways 220 of the insulative housing 2. The contacts 3 include a plurality of signal contacts 30 and ground contacts 32. An upper portion of each ground contact 32 is nearer to a top end of the mating section 22 than an upper portion of each signal contact 30 such that, when the electrical connector 1 mates with the complementary connector, the ground contacts of the electrical connector 1 and the complementary connector will respectively engage with each other before the signal contacts do.

The board lock 4 comprises a base portion 40, a pair of barbs 41 on each of opposite sides of the base portion 40, and a pair legs 42 extending downwardly from a bottom end of the base potion 40. Each leg 42 forms an engaging tail 43 at a distal end thereof.

The printed circuit board 5 defines a plurality of apertures 52, a pair of bores 51 and a hole 53, respectively in accordance with tails of the contacts 3, the posts 26 and the board lock 4.

In assembly, the contacts 3 are inserted into the passageways 220 of the housing 2 from the bottom surface 204 of the base section 20 until the upper portion of each contact 3 abuts against a top end of the corresponding passageway 220 for preventing the contacts 3 from flexing. The guiding posts 26 insert into the through holes 25 of the housing and project beyond the bottom surface 204 of the connector 1 for being inserted into corresponding through holes 51 of the printed circuit board 5. When the board lock 4 is received in the receiving cavity 280 of the retention portion 28 with the barbs 41 engaging with inner walls of the retention portion 28. When the connector 1 is mounted onto a printed circuit board 5, the tails of the contacts 3 are correspondingly received the apertures 52, and the engaging tail 43 of the board lock 4 engage with inner wall of the hole 53, and the posts 26 pass through the bores 51. Solders are applied to the tails of the contacts 3 and the posts 26 for securing retention.

This present invention provides two ports in a single housing with a pair of posts arranged in a diagonal line and a board lock received in the housing. The connector of this invention is more compact and taking less space on a board than the convention connectors, while increase the stability of the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a printed circuit board comprising:

an integral insulative housing comprising: a first and a second base section spaced apart from each other in a substantially parallel relationship and each having a top and bottom face; and a first and a second mating section respectively projecting upwardly from the top faces of the first and second base section, the first and second mating section respectively defining a plurality of first and second passageways extending through the first and second base portion;

an interconnect portion integrally interconnecting the first base section with the second base section; and a plurality of first and second contacts received in the first and second passageways of the housing, respectively;

wherein the interconnect portion comprise a pair of bridges interconnecting the first base section and the second base section;

wherein the interconnect portion further comprise a retention portion between the bridges interconnecting middle portions of the first base section and the second base section;

wherein the retention portion defines a receiving cavity therein;

wherein a board lock is received in the receiving cavity, the board lock comprising a base portion, a pair of barbs formed on sides of the base portion for engaging with inner walls of the receiving cavity and a pair of legs extending downwardly from a bottom end thereof, an engaging tail projecting from an edge of the leg;

wherein the first and second passageways are arranged in a single row and extend from the mating section to the bottom surface of the base section;

wherein the first and second base section together define a pair of through holes in a diagonal line of the housing;

wherein a pair of separate posts passes through the corresponding through holes of the first base and second section and extends through bores defined in a printed circuit board for securing the connector onto the printed circuit board.

2. The electrical connector as claimed in claim 1, wherein when the connector is mounted on the printed circuit board, the engaging tail of the board lock engages with an inner wall of a hole defined in a printed circuit board for securing the connector onto the printed circuit board.

* * * * *